United States Patent [19]

Yager

[11] 4,149,722

[45] Apr. 17, 1979

[54] PRE-FORMED RACKET STRING WITH INTER-LOCKED WEBBING

[76] Inventor: Victor Yager, 2712 Ditmars Blvd., New York, N.Y. 11105

[21] Appl. No.: 668,644

[22] Filed: Mar. 19, 1976

[51] Int. Cl.[2] ..... A63B 51/02

[52] U.S. Cl. ..... 273/73 D; 273/73 A

[58] Field of Search ..... 273/73 R, 73 C, 73 D, 273/73 E, 73 H, 29 B

[56] References Cited

U.S. PATENT DOCUMENTS

| | | | |
|---|---|---|---|
| 1,132,214 | 3/1915 | Ries et al. | 273/73 D |
| 3,912,267 | 10/1975 | Lyon | 273/73 D |
| 3,966,207 | 6/1976 | Pass | 273/73 D |

FOREIGN PATENT DOCUMENTS

| | | | |
|---|---|---|---|
| 981444 | 1/1951 | France | 273/73 D |
| 3127 of | 1885 | United Kingdom | 273/73 D |
| 415591 | 8/1934 | United Kingdom | 273/29 B |
| 566130 | 12/1944 | United Kingdom | 273/73 D |

*Primary Examiner*—Richard J. Apley

[57] ABSTRACT

A loosely woven network of racket string cordage, preferably employing a single continuous member and woven to form a substantially horizontal and vertical pattern with inter-locking at each intersection of the horizontal and vertical lines and with a mass dimension and peripheral configuration to suit conventional racket frame designs including circumferentially disposed closed loops to serve as anchoring means in said frame after being stretched to a proper degree of tension with the use of a tensioning machine typical of the within described mechanism.

2 Claims, 5 Drawing Figures

PRE-FORMED RACKET STRING WITH INTER-LOCKED WEBBING

This invention deals with tennis rackets and the like and more particularly with the stringing which comprises the striking area of the racket and means for installing same.

In the conventional racket the string is pulled tight through holes in the frame with the aid of machinery and hand tools to hold the string in a taut position as each successive row is stranded into place over and under each other at cross angles in a manner commonly known as a "basket weave."

According to the average player preference the stringing is performed with a nominal tension of 25 kilograms on each line. This results in a semi-rigid webbing over the striking area of the racket. In addition to tight stringing, many players choose rackets of maximum stiffness in the belief that powerful strokes are thus enhanced. In consequence, tennis players are prone to a common ailment that is generally referred to as "tennis elbow." This is a condition attributable to the shock sustained by the arm muscles with each hit during a period of strenuous play; especially the solid hit as typified by a "ping" sound as the racket meets the ball. The obvious remedy for this is low-tension stringing which, however, is spurned by most players because ordinary strings go flat and unwieldly at low tension.

Conventional stringing even at high tension tends to slide out of alignment during play, especially when the player executes a sliced serve or attempts to induce a controlled spin to the ball by an angled strike. With the strings thus in disarray a degree of control is lost and the player is obliged to take corrective measures during play. Also, the strings are subject to needless wear by the reciprocal friction resulting from normal play.

Still another objectionable feature of conventional stringing is that the weaving must be done on individual racket frames mounted in normally heavy machinery and finished by expert craftsmen in order to achieve a satisfactory result. Thus a busy season may signal long delays in service availability to the average player as each job requires considerable time and concentration to complete in one sitting.

In view of the aforesaid limitations of ordinary racket strings it is my objective to improve string performance from the players standpoint as well as to simplify its installation into a racket frame.

Accordingly, I have devised a webbed string assembly woven independently of the racket on a peg-board, as a first experiment, which yields a network of horizontal and vertical strings having approximately the same number of squares as ordinary stringing but with interlocking at each intersection of the main and cross strings. The resulting structure shows a gain in resilience in the tightly strung network due to the zigzag course of the individual strands and the considerable greater length required for each string to span the racket face. This combination of factors: greater string length and interlocked webbing radically effect string performace by an increase in its elastic limit and rebound velocity. In effect, the "ping" is gone out of striking a tennis ball while the power is enhanced to make the play less punishing on the arm muscles.

Static tests made by dropping a weighted ball onto a racket from a height of 1 meter have shown that the new string will rebound the ball a greater distance by 15% than the conventional "basket weave." The difference can be likened to that of a bow and arrow: the longer the string the greater the stretch and, consequently, longer the throw.

Players who suffer the pain of "tennis elbow" require a lower tension stringing to offset the shock of each hit. It is well known that low tension causes the conventional string to go flat, unwieldly and quite useless. Conversely, the new string with its interlocked cross lines and unified webbing allows the stresses imposed on a small area to be shared by the entire network and thus makes a firm, responsive racket string with full playing qualities when strung at low tension.

In order to identify a low tension stringing from what is regarded as a normal tension I have devised a calibrating system by which a 10 kilogram load is applied to the center of the racket with a regular tennis ball as a buffer and the resulting yield of the strings can be measured in millimeters. Thus a low tension string registering a deflection of 9 millimeters off level is most suitable for players with elbow problems while a normal tension preferred by stronger players would register about 5 millimeters.

In addition to the above, the unique construction of the new string results in a further advantage to the player in that the interlocking of the strands generates a knotty elevation at each intersection of the vertical and horizontal lines and this provides a series of uniformly spaced protuberances over the entire webbing which tend to spike the ball on impact and allow the player's racket follow-through to control the flight of the ball rather than have such control dependent entirely on the precise angle of the racket face at the moment of contact.

A primary feature of this novel string design is that this modular concept allows the chore of weaving to be performed independently of the racket frame and thus to be packaged in a semifinished state. The routine of weaving is the most time-consuming in the whole process and, though intricate, it is repetative and easily learned from illustrations so that it may now be performed in comparative leisure even by some who are physically handicapped.

Still another advantage in this modular string concept is that rackets may be designed with suitable hooks along the inner periphery of the frame to serve as anchor points for the outer loops of the string webbing. An example of this is shown in the illustration FIG. 5. By this means the joining of strings to racket may be greatly simplified and accelerated. Accordingly, the present invention includes such a combination of performed string and racket.

The invention may be better understood by reference to the accompanying illustrations.

Figure 1:
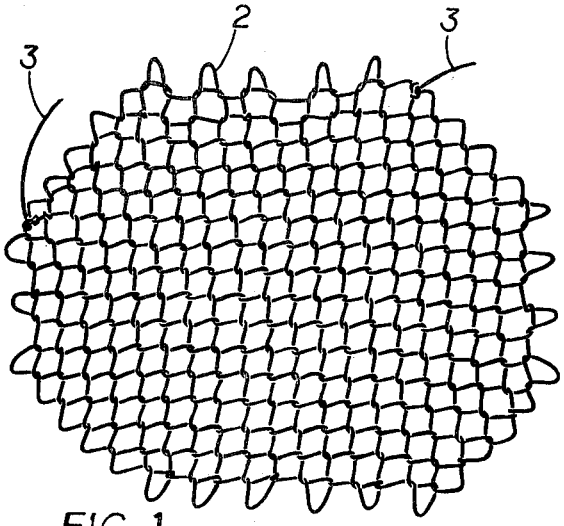
FIG. 1 shows a pre-woven string of the present invention ready for packaging or mounting on a racket.

In greater detail, FIG. 1 illustrates the preferred embodiment of a tennis racket string module. I call this network a module since it may be packaged and stored or fitted to any racket and even removed intact from one racket and fitted to another. The closed loops 2, which circumscribe the network are provided for anchoring to the hooks on the novel racket frame illustrated in FIG. 5, or to be joined to a conventional racket frame by lacing through the holes provided therein. In the latter case, a separate length of string is used for the lacing, preferably of the same cut as the string in the pre-woven module.

Figure 2:
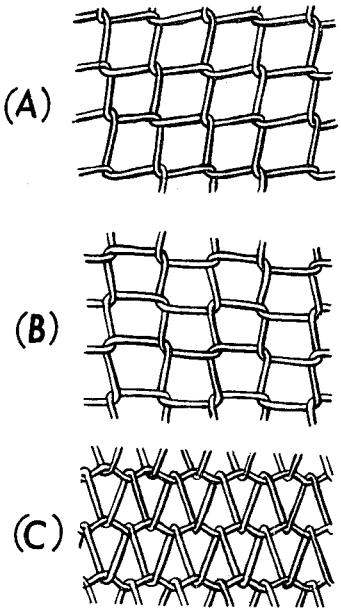
FIG. 2 shows an enlarged section of webbing with the preferred weave pattern A, and two alternate styles of weave, B and C.

In FIG. 2, the unique inter-locked weave is shown in three different styles, or patterns. In all cases there is an over-and-under progress of string undulations from one intersection to another to make for maximum unification of the webbing so that stresses imposed on the network from any direction are resisted by the conglomerate. Style A is most preferred for its simplicity. Style B is equally suitable but is more painstaking in manufacture. Style C is most adaptable for use of thin metallic stringing with comparatively fine mesh and greatest durability.

Figure 3:
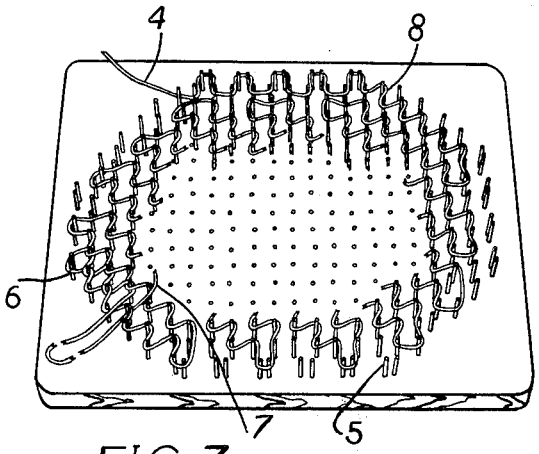
FIG. 3 illustrates a pin-board with racket string in the process of weaving.

The string module is produced on a novel pin-board shown in FIG. 3. Starting with a five meter length of racket string at point 4, convolutions of strings are formed around a multitude of vertical pins 5, projecting from the board in a prescribed formation to provide the desired number of squares in the network to suit the racket frame. The initial pass from the starting point 4, is made in sequence around a rownof pins following a path that is traced on the board to aid the operator. When point 6 is reached the return cycle begins and the trailing end of the string becomes the leader 7, and it must be inter-locked with the prior convolution at each pin station in its zigzag course back to the finish point 8, for completion of the webbing. The prevailing rule in the return cycle is that the weaving be performed by an over-and-under sequence of undulations from each pin station to the next and at no section of the network may the strings go twice over the same span. Upon completion of the weave, the ends are secured to the main body of the webbing with hitch-type knots 3, (FIG. 1) The finished module may then be pried from the board out of contact with the pins, preferably after being attached to an elastic suspension ring equipped with clasps for the outer loops to forestall curling of the network.

Figure 4:
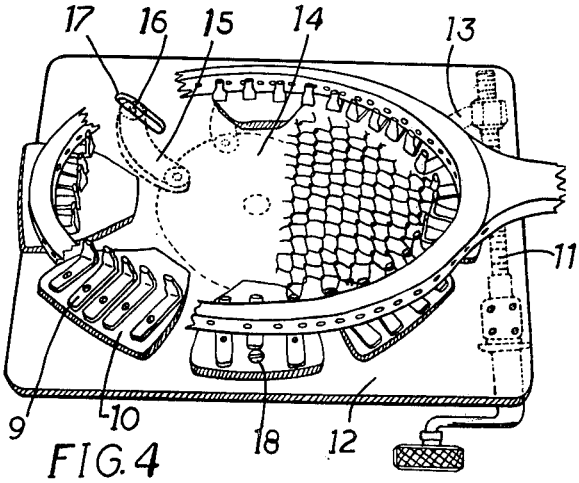
FIG. 4 is a perspective view of a tensioning machine with an in-part string webbing in place, partially stretched, and with a racket frame in position to receive same.

In FIG. 4 a fragmented perspective view of the string is shown mounted in a novel tensioning machine with a conventional racket frame shown in position to receive same. A series of vertical fingers 9, secured to a plurality of slide plates 10, which are movable outward radially from a central point, engage the string loops while at loose tension and the mechanism provides for a simultaneous radial movement of the vertical fingers and thereby stretching the webbing to the desired tautness at which time lacing of the webbing to the racket frame may begin. The mechanism actuating the plates 10, is detailed in the dotted lines and begins with manual manipulation of the screw 11, which is pivotally secured to the baseplate 12, and engages an extension arm 13, integrated with a rotatable disk 14, which is a vehicle for a multitude of elbow levers 15, actuated by said sdisk in a reciprocal movement of a stud 6, within the slot 17 to engage a fastener 18, holding the slide plate to movement within the limits of the slot. An elbow lever, stud, and slot is, of course, associated with each of the said slide plates.

Figure 5:
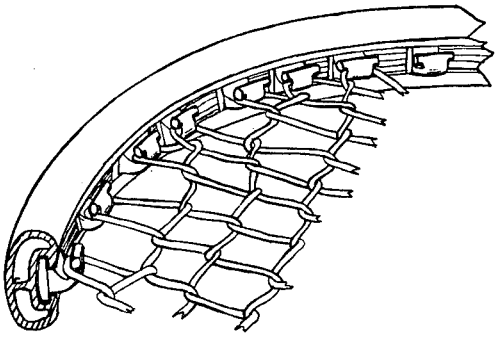
FIG. 5 shows an in-part perspective view of a novel racket frame provided with hooks to engage the loops on the pre-woven string webbing.

In FIG. 5 the racket design illustrated in sectional drawing is specially suited for the inter-locked string system. It has desirable features from the commercial standpoint in that the drilling of 60 or more holes in the racket head is outmoded and the component parts can be assembled as cast from the mold. Also, speedy installation of the string at time of purchase is made feasible.

It is within the scope of the present invention to make such variations and modifications and substitutions of equivalents as would be consistent with normal shop practice and my continuing dedication to the further advancement of the present art.

I claim:

1. In combination, a preformed racket string network woven independently of the racket frame consisting of a single string member wherein a plurality of rows of string lines form a pattern of linkage, said pattern comprising opposing points of zigzag lines being interlocked at converging points by an over-and-under undulation of the strings coincident with an approximately 90 degree turn of each line and defining a generally oval shaped webbing of interlocked squares, wherein no section of the string network is spanned more than once by the string lines, said pattern further having a uniform facing on both sides of the string network and further including a series of annular closed peripheral loops whereby the string network can be tensioned and mounted onto a racket frame.

2. In combination, a preformed racket string network comprising a plurality of string members forming a pattern of linkage, said pattern comprising opposing zigzag lines of string being interlocked at converging points by an over-and-under sequence of string undulations coincident with an approximately 90 degree turn of each line at said converging points to form an integral unit of interlocked squares, wherein no section of the string network is spanned more than once by the string lines, said pattern further having a uniform facing on both sides of the string network and further defining a generally oval shaped webbing including 37 annular closed peripheral loops whereby the string network can be tensioned and mounted onto a rocket frame.

* * * * *